United States Patent [19]

Lewis

[11] Patent Number: 4,923,429

[45] Date of Patent: May 8, 1990

[54] BUBBLE-PROPELLED AMUSEMENT DEVICE

[75] Inventor: Jeffrey B. Lewis, Old Greenwich, Conn.

[73] Assignee: Lewco Corp., New York, N.Y.

[21] Appl. No.: 390,274

[22] Filed: Aug. 7, 1989

[51] Int. Cl.[5] ..... A63H 29/10; A63H 23/00; A63H 3/52; A63B 67/00

[52] U.S. Cl. ..... 446/197; 446/156; 446/267; 273/1 L; 40/406

[58] Field of Search ..... 446/197, 198, 267, 195, 446/193, 199, 180, 176, 153, 156, 159, 160, 163; 40/406, 409, 410; 273/1 L, 337, 338, 339

[56] References Cited

U.S. PATENT DOCUMENTS

| | | | |
|---|---|---|---|
| 1,893,507 | 1/1933 | Ranney | 446/163 X |
| 2,540,502 | 2/1951 | Aschbacher | 446/160 X |
| 3,009,286 | 11/1961 | Warner | 446/267 X |
| 3,061,970 | 11/1962 | Knott | 446/267 X |
| 3,205,610 | 9/1965 | Palumbo et al. | 446/193 |
| 3,246,419 | 4/1966 | Pawelka et al. | 446/163 X |
| 3,253,354 | 5/1966 | Gollner et al. | 446/267 X |
| 3,469,340 | 9/1969 | Breneman et al. | 446/197 |
| 3,998,001 | 12/1976 | Meyer et al. | 446/197 |
| 4,032,141 | 6/1977 | Tanimura | 273/1 L |
| 4,223,471 | 9/1980 | Greenberg | 446/198 |

FOREIGN PATENT DOCUMENTS

| | | | |
|---|---|---|---|
| 1076803 | 5/1980 | Canada | 446/153 |
| 263836 | 9/1913 | Fed. Rep. of Germany | 446/153 |

*Primary Examiner*—Robert A. Hafer
*Assistant Examiner*—D. Neal Muir
*Attorney, Agent, or Firm*—Michael Ebert

[57] ABSTRACT

A bubble-propelled amusement device in which play pieces are dispersed in a water bath contained in an enclosed transparent tank having on its bottom wall an air nozzle and having in the air space above the bath an air intake, the pieces normally tending to sink toward the nozzle. Below the tank is a pump assembly comprising an air chamber coupled to a player-operated bellows, the chamber being provided with an air outlet and an air inlet, each having a check valve therein. The air outlet is coupled to the nozzle so that when the bellows is actuated by the player and compressed, the resultant positive air pressure in the chamber causes the outlet valve to open to feed air into the nozzle which injects into the water bath a stream of air bubbles that act to propel play pieces toward a target, the bubbles then being discharged into the air space. When the bellows is released by the player and permitted to expand, the resultant negative air pressure in the chamber causes the inlet valve to open to draw air from the air space into the chamber. Thus the pump assembly forms with the tank a closed air loop and is isolated from the water therein.

9 Claims, 2 Drawing Sheets

BUBBLE-PROPELLED AMUSEMENT DEVICE

BACKGROUND OF THE INVENTION

1. Field of Invention:

This invention relates generally to toys or amusement devices of the type in which play pieces dispersed in water contained in a transparent tank are propelled by a player toward a goal or target, and more particularly to a device in which the propulsive force for this purpose is a stream of air bubbles produced by a player-actuated air pump assembly operatively coupled to the tank.

2. Status of Prior Art:

U.S. Pat. No. 4,142,715 to Matsumoto and U.S. Pat. No. 4,032,141 to Tanimura disclose amusement devices in which a transparent tank filled with water has dispersed therein play pieces in the form of rings or other members having a specific gravity greater than water so that the pieces tend to sink to the bottom of the tank. Coupled to the tank bottom is a water pump which when actuated by a player shoots a stream of water into the tank that acts to propel the play pieces toward a goal or target. The object of this toy is to so operate the liquid pump as to cause the pieces to be caught by or fall into the target.

The practical drawback of a toy of this type in which the propulsive force is a water stream is that the player, while he can see the effect of the stream on the play pieces on which the stream impinges, is unable to see the stream itself, for the stream of water produced by the water pump is not visibly distinguishable from the pool of water into which the stream is injected.

Since the player cannot see the stream of water but only its effect on the play pieces, he cannot see the direction it takes, and this makes it difficult for the player to control the play pieces. Thus if the play pieces are small basketballs and the target a miniature basketball goal, it is then hard for the player to so manipulate the water pump as to avoid overshooting the goal.

Inasmuch as the present invention makes use of air bubbles as the propulsive force rather than a liquid stream as in the above-noted patents, the U.S. Pat. No. 3,733,738 to Kramer, is pertinent. In Kramer, an air pump blows bubbles into a column of water, the bubbles being intercepted by a capsule which is caused to rise and fall in the column under the control of the pump operator.

Also of background interest is the U.S. Pat. No. 4,568,302, to Henderson, in which an air bellows pump acts to blow air bubbles into a water tank to provide a bubble bath for a doll immersed in the tank. The use of air to impel balls toward a target is shown in the U.S. Pat. No. 3,711,097, to Begley, but there is no water in his arrangement.

SUMMARY OF INVENTION

In view of the foregoing, the main object of this invention is to provide an amusement device in which play pieces dispersed in a bath of water partially filling an enclosed transparent tank are propelled by a stream of air bubbles toward a target or goal, the air bubbles being generated by a player-actuated air pump assembly operatively coupled to the tank.

A significant advantage of the invention is that the stream of air bubbles is visible to the player, making it easier for him to so manipulate the air pump assembly as to direct the play pieces toward the goal, and also giving the player the feeling of greater control over the operation of the amusement device. Moreover, the generation of visible air bubbles by the player enhances the appeal of the amusement device.

More particularly, an object of this invention is to provide an amusement device of the above type whose transparent enclosed tank is fillable with water to create a water bath therein at the required level, the arrangement being such as to isolate tank water from the air pump assembly and to isolate the assembly from the atmosphere and thereby form a closed air loop between the enclosed tank and the assembly.

Also an object of the invention is to provide an amusement device which is reliable and efficient in operation, and which can be manufactured at low cost.

Briefly stated, these objects are attained in a bubble-propelled amusement device in which play pieces are dispersed in a water bath partially filling an enclosed transparent tank having on its bottom wall an air nozzle and having in the air space above the bath an air intake, the pieces normally tending to sink toward the nozzle. Below the tank is a pump assembly comprising an air chamber coupled to a player-operated bellows, the chamber being provided with an air outlet and an air inlet, each having a check valve therein.

The air outlet is coupled to the nozzle so that when the bellows is actuated by the player and compressed, the resultant positive air pressure in the chamber causes the outlet valve to open to feed air into the nozzle which injects into the water bath a stream of air bubbles that act to propel play pieces toward a target, the bubbles then being discharged into the air space. When the bellows is released by the player and permitted to expand, the resultant negative air pressure in the chamber causes the inlet valve to open to draw air from the air space into the chamber. Thus the pump assembly forms with the tank a closed air loop and is isolated from the water therein.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
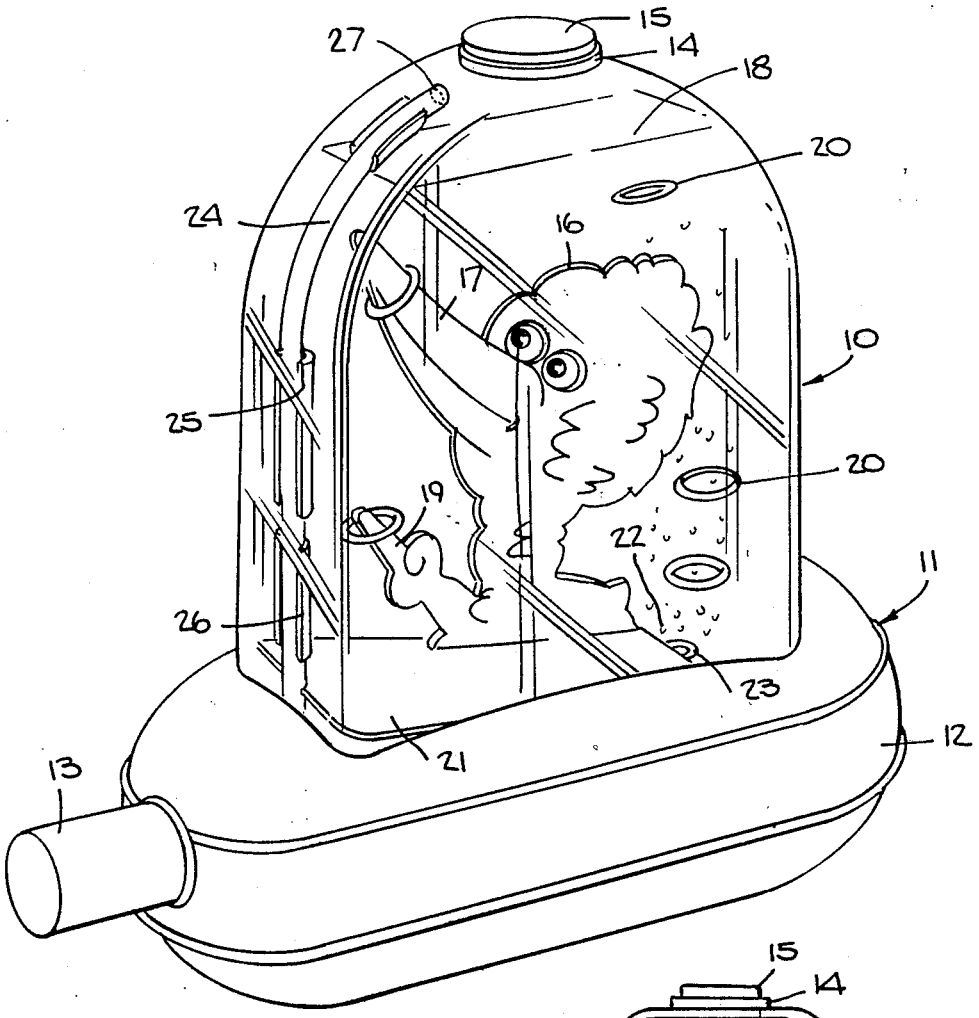
FIG. 1 is a perspective view of an air propelled amusement device in accordance with the invention.
Figure 2:
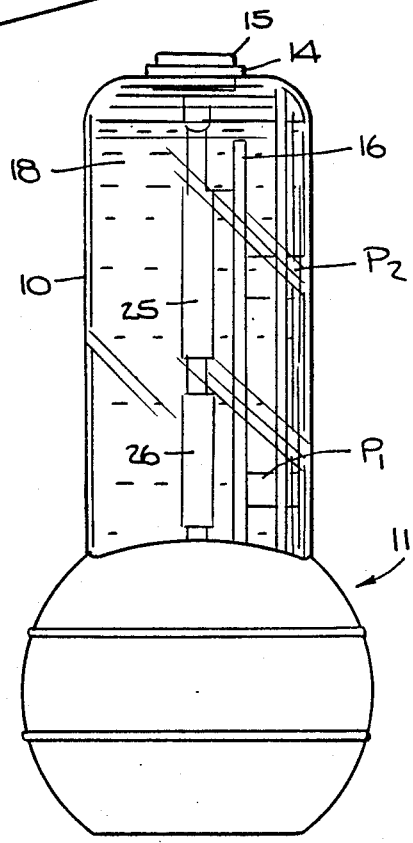
FIG. 2 is an end view of the device with the tank shown in section.

Referring now to FIGS. 1 and 2, there is shown an air-propelled amusement device in accordance with the invention whose main components are a transparent tank 10 mounted above an air pump assembly, generally designated by numeral 11, having a molded plastic case 12 from one end of which projects a push button 13.

Tank 10, which is of molded, transparent, plastic material, has a generally rectangular cross section and an arched top wall having an open neck 14 at its center to receive a removable stopper 15. Supported within the tank is a target plate 16 formed of rigid plastic material that is edge contoured to define an animal or bird having an upraised beak 17. Beak 17 acts as a target for play pieces which are dispersed in a water bath 18 partially filling the tank. Target plate 16 also includes a pointed up finger 19 serving as a second target. The target plate 16 is supported by transparent plastic posts $P_1$ and $P_2$ anchored in the rear wall of the tank.

Dispersed within bath 18 are play pieces 20 in ring form having a diameter such that the rings can hook onto targets 17 and 19. Rings are shown by way of example only, for the play pieces may be in ball or in any other form, and the targets need not be spike-like, as shown, but may take the form of a miniature basketball goal or any other form appropriate to the nature of the play pieces.

The specific gravity of play pieces 20 is such that they do not float on the surface of the liquid bath but tend normally to sink to the bottom wall 21 of the tank. This wall is inclined to form a ramp leading toward a depressed well 22 having mounted therein an air nozzle 23.

Extending upwardly along one side wall of the tank is a transparent plastic tube 24 which is held against the wall by clear plastic fixtures 25 and 26 and terminates in an air intake 27. This air intake is positioned in the head of air or air space above the level of the water bath. When the tank is partially filled with water to create bath 18 therein, it is not filled to the top, but to level leaving an air space above the bath.

In operation, when a player depresses push button 13 to actuate the air pump assembly, a stream of bubbles is expelled from nozzle 23 in the water bath, and these act to propel play rings 20 upwardly. The player repeatedly actuates the push button to shoot out the bubbles with varying force in order to propel the rings in a direction toward the targets. Since the rings are subjected to the upward force of the air bubbles and the downward force of gravity, and the upward force is not exactly vertical but at an angle that depends on the collective effect of the pattern of air bubbles in the right hand region of the tank, the rings can be made to travel in a curved path leading to the targets which are in the left hand region of the tank. Those rings which miss the targets sink to the bottom wall ramp in the tank and move toward well 22 where they are exposed to nozzle 23 and are again subjected to the bubble action.

The air bubbles rise in the water bath and are discharged into the air space thereabove where the air is sucked back into the air pump assembly 11 through air intake 27. When the tank is filled with a proper amount of water and stopper 15 put back in place, the tank is then sealed and atmospheric air is excluded therefrom. Hence the air which is pumped into air nozzle 23 is derived from the air space within the sealed tank and not from the atmosphere, so that in operation the air within the tank is circulated within a closed loop.

The Air Pump Assembly

Figure 3:
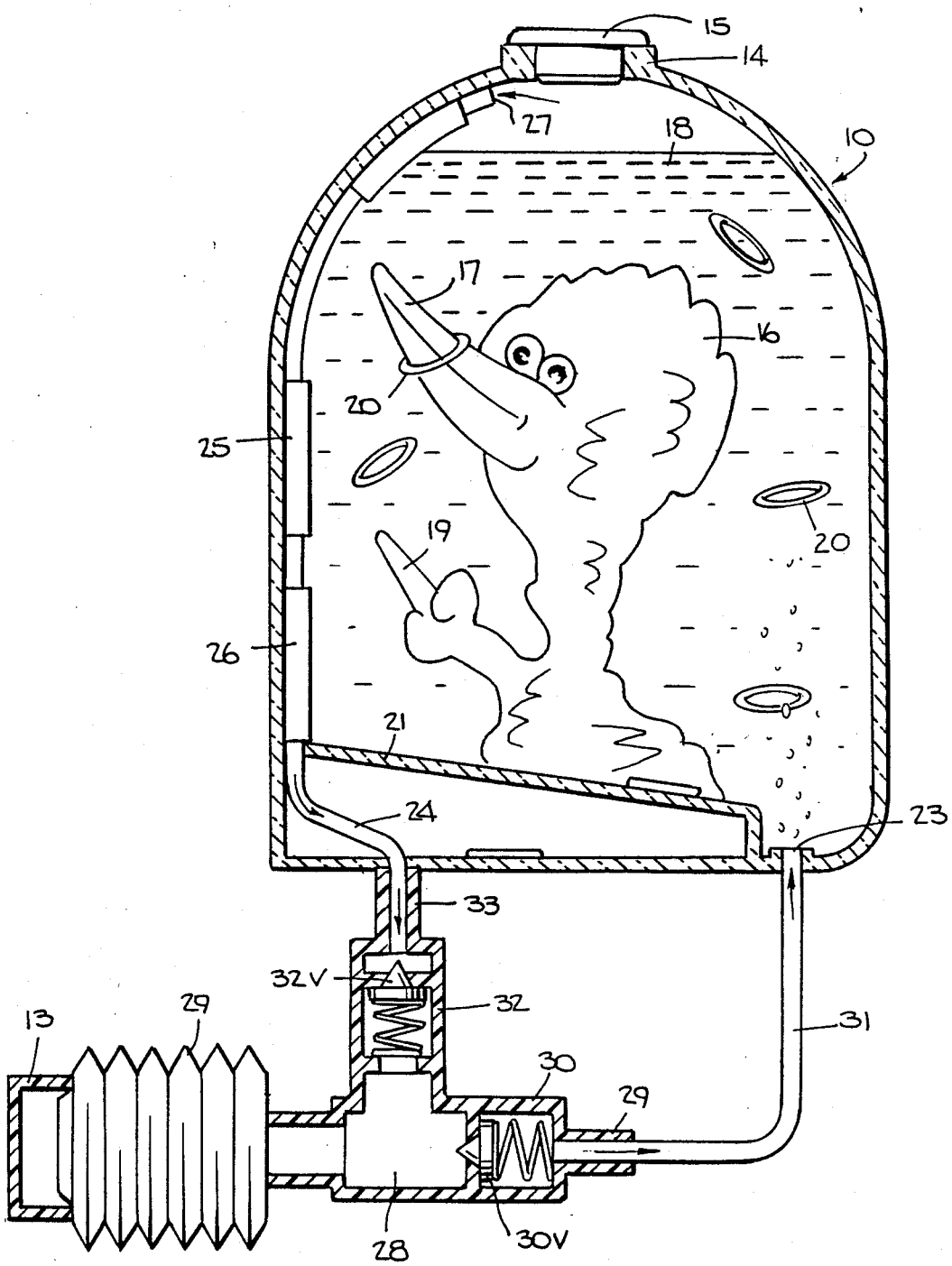
FIG. 3 is a sectional view of the air pump assembly included in the device.

As shown separately in FIG. 3, the air pump assembly 11 comprises a cylindrical air chamber 28, one end of which is axially coupled to a blow-molded bellows 29 to which push button 13 is attached. Hence when the button is pressed in by a player, the bellows is compressed to produce a positive pressure in air chamber 28. The other end of air chamber 28 is axially coupled through a normally-closed check valve 30 to an air outlet 29. Outlet 29 is coupled by a tube 31 to nozzle 23 in the bottom of tank 10.

Outlet valve 30 includes a spring-biased valve member 30V, which when a positive air pressure is produced by the bellows in air chamber 28 is forced open to feed air into nozzle 23 from which the air is injected into the water bath to produce a stream of bubbles therein which propel the play pieces.

Extending laterally from air chamber 28 is a check valve 32 leading to an air inlet 33 coupled to tube 24 terminating in air intake 27. Inlet valve 32 includes a spring-biased valve member 32V which is normally closed. But when bellows 29 is released by the player and expands to resume its normal form, then a negative pressure is developed in air chamber 28 which causes inlet valve 31 to open and to draw air from the air space in tank 10 into air chamber 28 to release the vacuum.

Thus outlet check valve 30 prevents water in the tank from entering the air pump assembly, for this valve opens only when a positive pressure is produced to force air into the tank, the forced air then going through tube 31 acting to expel water therefrom.

The arrangement is such that the air pump assembly is isolated from the tank water and is also isolated from atmospheric air, for the air circulates in a closed loop.

While there has been shown and described a preferred embodiment of a bubble-propelled amusement device in accordance with the invention, it will be appreciated that many changes and modifications may be made therein without, however, departing from the essential spirit thereof. Thus instead of a bellows, the pump may be a spring-biased, piston-operated air pump.

I claim:

1. An air-propelled amusement device comprising:

(a) an enclosed tank of transparent material partially filled with water to produce a water bath and an air space above the bath;

(b) play pieces dispersed in the bath having a specific gravity, such that the pieces tend to gradually sink to the bottom of the tank;

(c) a target disposed within the tank to receive play pieces propelled toward the target; and (d) a player-actuated air pump assembly associated with the tank and external thereto adapted to withdraw air from the air space and to inject this air into the bottom of the tank to produce a stream of air bubbles which propel the play pieces toward the target, said tank being provided with a nozzle at its bottom from which the air is injected into the water to produce a stream of air bubbles that impinge on the pieces that sink to the proximity of the nozzle, and an air intake disposed in the air space from which the air is withdrawn and being operatively coupled to the air pump, whereby the air circulates in the tank in a closed loop.

2. A device as set forth in claim 1, wherein the tank is provided at its top with a removable stopper for supplying water thereto.

3. A device as set forth in claim 1, wherein the assembly includes a push-button actuated bellows which when actuated produces said bubbles, and which when released withdraws air from the air space.

4. A device as set forth in claim 3, wherein said assembly includes an air chamber coupled to said push-button actuated bellows such that when the bellows is compressed by the player, a positive pressure is produced in the chamber, and when the bellows is released and thereby permitted to expand, a negative pressure is produced in the chamber.

5. A device as set forth in claim 4, further including an outlet having a check valve therein coupled to said air chamber, which outlet valve is opened under positive pressure to feed air from the chamber to the nozzle, and an inlet having a check valve therein coupled to the air intake, which inlet valve is opened under negative pressure to withdraw air from the air space.

6. A device as set forth in claim 5, wherein the outlet is coupled by a tube to the nozzle.

7. A device as set forth in claim 5, wherein the inlet is coupled by a transparent tube to the air intake.

8. A device as set forth in claim 1, wherein said pump assembly is contained in a plastic case and said tank is mounted on top of said case.

* * * * *